United States Patent [19]

Alluto et al.

[11] Patent Number: 4,530,217

[45] Date of Patent: Jul. 23, 1985

[54] DEFROSTING DEVICE FOR A REFRIGERATOR

[75] Inventors: Luigi Alluto; Fabio Fancelli, both of Moncalieri, Italy

[73] Assignee: Indesit Industrial Elettrodometici Italiana S.p.A., Turin, Italy

[21] Appl. No.: 486,369

[22] Filed: Apr. 19, 1983

[30] Foreign Application Priority Data

Apr. 20, 1982 [IT] Italy ..... 67519 A/82

[51] Int. Cl.[3] ..... F25D 21/06; G05D 23/19

[52] U.S. Cl. ..... 62/156; 62/154; 62/158

[58] Field of Search ..... 62/156, 155, 151, 152, 62/154, 158, 234, 276, 275, 272, 180, 140

[56] References Cited

U.S. PATENT DOCUMENTS

| | | | |
|---|---|---|---|
| 2,130,036 | 9/1938 | Shrader | 62/156 X |
| 2,720,086 | 10/1955 | Tarleton | 62/156 |
| 3,726,105 | 4/1973 | Auracher | 62/156 |
| 4,299,095 | 11/1981 | Cassarino | 62/156 X |
| 4,305,259 | 12/1981 | Jaeschke | 62/140 |

*Primary Examiner*—Harry B. Tanner

*Attorney, Agent, or Firm*—Gifford, VanOphem, Sheridan, Sprinkle & Nabozny

[57] ABSTRACT

The present invention relates to a defrosting device, for a refrigerator with a number of cooling compartments, which only supplies heat to the evaporator in the fresh food compartment when strictly necessary, that is, when fast defrosting is required, whereas it provides for natural defrosting as long as this is sufficient. In a first arrangement, fast defrosting is performed each cooling cycle but only for part of the time the compressor is off and only after a given temperature threshold has been exceeded by the evaporator in the fresh food compartment or by the freezer. In a second arrangement, fast defrosting is only performed for one out of "n" number of cycles. Both these arrangements provide for energy saving as compared with known technology besides improving fast freezing performance by reducing food freezing time again as compared with known technology.

42 Claims, 4 Drawing Figures

DEFROSTING DEVICE FOR A REFRIGERATOR

BACKGROUND OF THE INVENTION

The present invention relates to a defrosting device for a refrigerator comprising a number of cooling compartments, of which at least one is used for storing fresh food and at least a second for storing frozen food, at least a first evaporator assigned to the fresh food compartment and at least a second evaporator assigned to the freezer, both with refrigerating fluid flowing through them in a series circuit, a compressor for compressing the refrigerating fluid, a condenser for condensing the refrigerating fluid from the compressor, a system of capillary tubes for supplying the refrigerating fluid from the condenser to the evaporators and at least one return pipe connecting the evaporators to the inlet on the compressor.

On known types of refrigerators with a number of cooling compartments, the fresh food compartment evaporator is defrosted at each cooling cycle by an electric resistor which is kept running as long as the compressor is off.

In other words, the complete cooling cycle on current refrigerators with more than one cooling compartment is as follows: when the fresh food compartment evaporator reaches a given maximum temperature, the compressor is started up. When the temperature of the said fresh food compartment evaporator falls to a given minimum, however, the compressor is turned off and, at the same time, the defrosting resistor turned on to heat the said fresh food compartment evaporator back up to maximum temperature. When the latter is reached, the defrosting resistor is turned off and the compressor turned back on to commence another cooling cycle.

The sole purpose of all this is to avoid too long a lapse of time between the fresh food compartment reaching minimum temperature and the compressor being started up again, which could happen if the system depended solely on natural defrosting. Should the compressor take too long to start up, the temperature in the freezer could exceed the allowed maximum with consequent damage to the foodstuffs stored inside.

The drawback on this defrosting system, however, is its crude design which results in twice the necessary waste in energy. At each cooling cycle, the refrigerator is supplied with heat the production of which requires the consumption of electricity for heating the defrosting resistor. This heat must then be extracted from the said refrigerator which means extra work for the compressor and further consumption of electricity.

SUMMARY OF THE INVENTION

The aim of the present invention is therefore to overcome the above drawbacks by providing a defrosting device, for a refrigerator with a number of cooling compartments, which only starts the defrosting resistor when strictly necessary so as to ensure efficient operation of the refrigerator and, at the same time, save on energy consumption.

A further aim of the present invention is to ensure the said device is reliable and reasonably cheap.

With these aims in view, the present invention relates to a defrosting device for a refrigerator comprising a number of cooling compartments, of which at least one is used for storing fresh food and at least a second for storing frozen food, at least a first evaporator assigned to the fresh food compartment and at least a second evaporator assigned to the freezer, both with refrigerating fluid flowing through them in a series circuit, a compressor for compressing the refrigerating fluid, a condenser for condensing the refrigerating fluid from the compressor, a system of capillary tubes for supplying the refrigerating fluid from the condenser to the evaporators and at least one return pipe connecting the evaporators to the inlet on the compressor, characterised by the fact that defrosting of the first evaporator is essentially natural and takes place at each operating cycle of the refrigerator when the compressor is off and that additional defrosting means are provided for only supplying the first evaporator with the additional amount of heat required for completing the defrosting process before the temperature in the second compartment exceeds the present maximum level.

BRIEF DESCRIPTION OF THE DRAWINGS

The invention will now be described with reference to the attached drawings, supplied by way of a non-limiting example, in which.

DETAILED DESCRIPTION OF THE INVENTION

Figure 1:
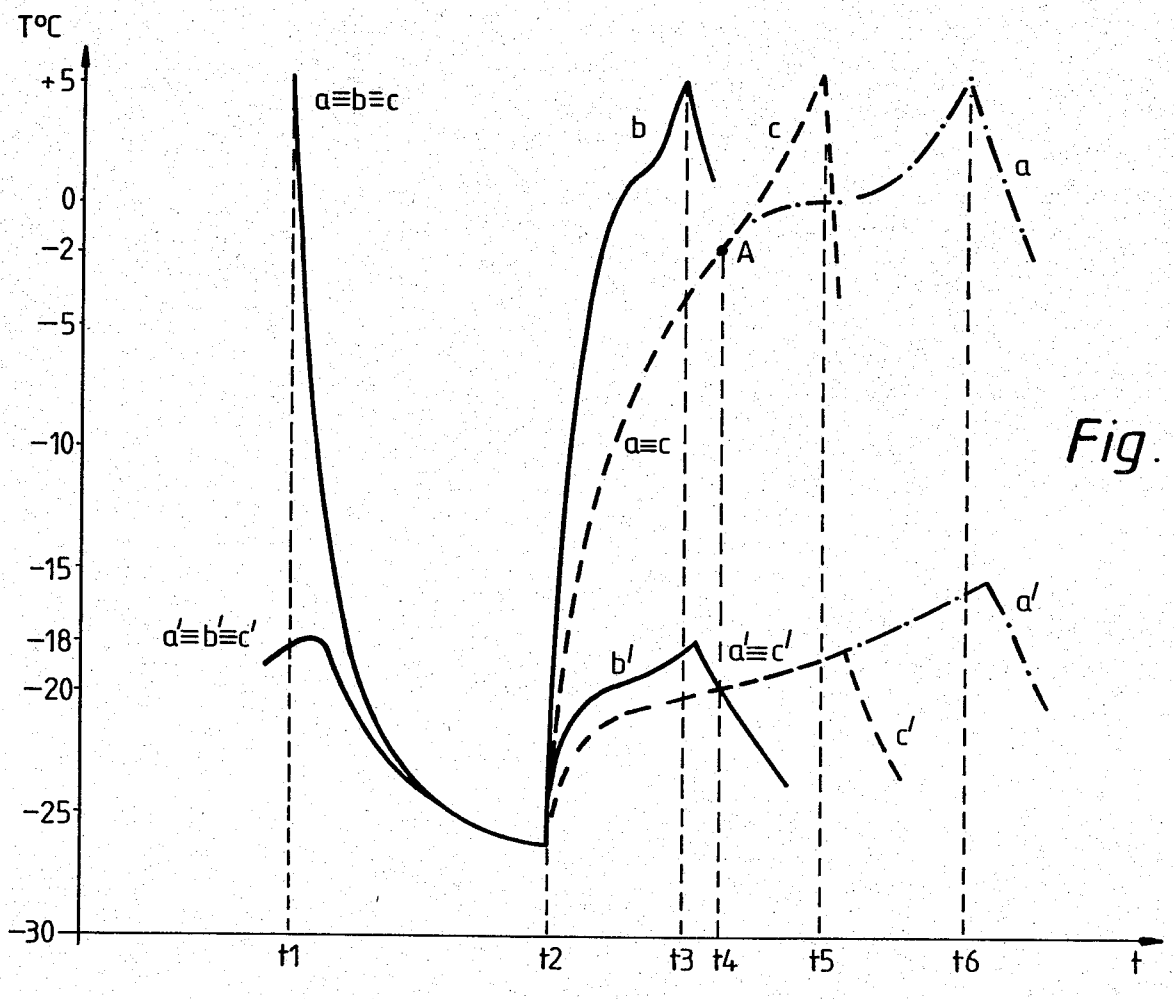
FIG. 1 shows temperature graphs of the fresh food compartment evaporator and freezer on a refrigerator with more than one cooling compartment, showing defrosting according to the known technique, natural defrosting with no assistance from a defrosting resistor and defrosting performed using the device covered by the present invention.

With reference to FIG. 1, curves "a" and "a'" (dot and dash line), "b" and "b'" (continuous line) and "c" and "c'" (dash line) shown the quality of the temperature on the fresh food compartment evaporator and in the freezer of a refrigerator with more than one cooling compartment in the case of natural defrosting, i.e. with no assistance from a defrosting resistor, defrosting performed using the known technique and defrosting according to the present invention respectively. t1 marks the point at which the cooling cycle commences when the compressor is started up and t2 the point at which the compressor is turned off. If we examine curves "a" and "a'" (natural defrosting), we see that, when the compressor is turned off (t2), the temperature on the fresh food compartment evaporator rises fairly rapidly at first and then more slowly, and that the compressor is turned on again (t6) when the temperature in the freezer exceeds −18° C. From the point of view of energy consumption, this solution would appear to be the best in that no outside heat is supplied to the refrigerator. It is unacceptable, however, in that, under no circumstances must the temperature in the freezer exceed −18° C. if the food already frozen is to be preserved. If we examine curves "b" and "b'" (defrosting according to the known technique), we see that, when the compressor is turned off (t2), the temperature of the fresh food compartment evaporator rises fairly rapidly and that the compressor is turned on again (t3) when the temperature in the freezer reaches roughly −18° C.

If we examine curve "a", however, we see that, in the case of natural defrosting, the temperature in the freezer at t3 is still below −20° C.

This means that, between t3 and t2, in the case of natural defrosting, the fresh food compartment evaporator has moved to about −20° C. whereas, in the case of defrosting according to the known technique, it has moved to about −18°.

This difference in temperature is caused by the heat supplied, in the second case, to the refrigerator by the defrosting resistor.

From this we can deduce that, if natural defrosting is not sufficient to ensure reliable operation of the freezer, defrosting according to the known technique is no more efficient in that it supplies the refrigerator with more than the required amount of heat and, what is more, it supplies it right from the start of defrosting when the difference in temperature between the fresh food compartment evaporator, which is around −25° C., and the fresh food compartment itself, which is around 5° C., is enough to ensure efficient heat exchange and, consequently, good natural defrosting. In fact, the start of curves "a" and "b" (after t2) are very similar. To conclude, therefore, the best solution, which is the one adopted by the present invention, is to make use of natural defrosting as long as this is sufficient and to use the defrosting resistor only as long at it is strictly necessary to ensure fast, complete defrosting of the fresh food compartment evaporator before the temperature in the freezer exceeds −18° C.

This aim is achieved by the defrosting device covered by the present invention the temperature performance of which is shown by curves "c" and "c'". As you can see from the curves, after the compressor is turned off (t2), natural defrosting takes place up to t4 at which point the defrosting resistor is turned on to ensure the temperature in the freezer does not exceed −18° C.

The curves also show how, in the interval t4–t2, both the compressor and defrosting resistor are off, with no consumption of energy, and how the cycle lasts from t5 to t1 instead of from t3 to t1 as in the case of defrosting according to the known technique.

This solution therefore provides for several advantages among which a dual saving in energy, in that the defrosting resistor is only left on for the time strictly necessary to ensure complete defrosting, at the same time consuming less electricity than the known defrosting technique; the compressor no longer has the extra job of extracting the superfluous heat supplied to the refrigerator and therefore also works for a shorter length of time as compared with the known defrosting technique; furthermore, the cooling cycles are longer (t5–t1) as compared with the known technique (t3–t1) and therefore fewer in number, which provides not only for energy saving but also for extending the working life of the compressor and refrigerator. The power of the defrosting resistor and the instant in which the resistor is to be turned on should, of course, be calculated to provide for maximum natural defrosting and, consequently, maximum energy saving, though at the same time ensuring that the temperature in the freezer does not exceed −18° C. For this purpose, a number of possible solutions have been worked out as shown in the drawings.

Figure 2:
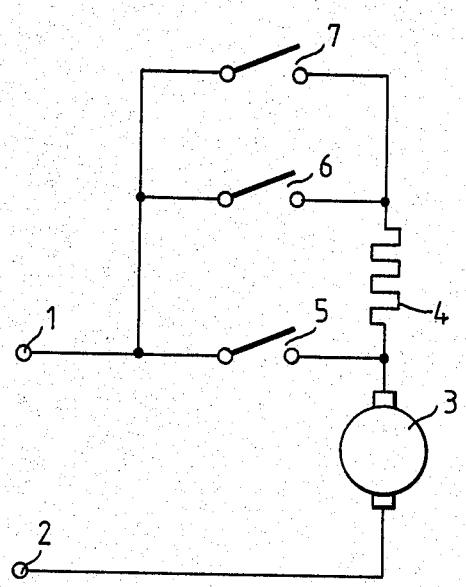
FIG. 2 shows a first possible arrangement of the defrosting device covered by the present invention for a refrigerator with more than one cooling compartment.

Reference numerals 1 and 2 in FIG. 2 indicate two supply terminals on the electricity mains. To terminal 2 is connected one end of compressor 3 on a refrigerator with more than one cooling compartment. The other end of compressor 3 is connected to one end of defrosting resistor 4, placed in contact with the fresh food evaporator on the same refrigerator, and with one terminal of a mechanical thermostat 5 also placed on the fresh food evaporator of the same refrigerator. The other terminal of mechanical thermostat 5 is connected to terminal 1 to which is also connected one end of any temperature-controlled switch element 6, or more specifically, a second mechanical thermostat, the other end of which is connected to the other end of defrosting resistor 4. Finally, a manual fast-freeze switch 7 is connected parallel to the contacts on the second mechanical thermostat 6.

The second mechanical thermostat 6 is placed on the fresh food evaporator but, in an alternative arrangement, it may also be placed inside the freezer compartment.

To understand how the present defrosting device works, we should point out that thermostat 5 can be set by the operator within a minimum and maximum temperature range. The said thermostat 5 closes, when the evaporator it is placed on reaches maximum temperature (5° C.) and opens when the said temperature falls to minimum (ranging from −17° to −25° C. depending on the setting made by the operator). The temperature-sensitive switch or second mechanical thermostat 6, however, is set to one specific temperature when the device is assembled at the plant, e.g. −2° C. (or −18.5° C. in the case of the alternative arrangement with the thermostat inside the freezer). The said temperature-sensitive switch 6 is closed, when the temperature in the compartment it is asembled in is higher than the switch setting (−2° C.; −18.5° C.), and open when the said temperature is below the setting. A refrigerator fitted with the present defrosting device operates as follows: when the temperature of the fresh food compartment evaporator rises to a maximum (5° C.), thermostat 5 closes and compressor 3 starts up to commence cooling. When the said temperature falls to a minimum (−17° to −25° C.), thermostat 5 opens to stop compressor 3. This is the point at which natural defrosting of the fresh food compartment evaporator commences, caused by the big difference in temperature between the evaporator itself, which is around −25° C., and the fresh food compartment, which is around 5° C. Consequently, the temperature of the fresh food compartment evaporator starts to rise again and, when it reaches −2° C., temperature-sensitive switch 6 closes and, as the contacts of thermostat 5 are open, supplies defrosting resistor 4 which supplies a large quantity of heat to the evaporator to raise the temperature rapidly and accelerate defrosting. When the temperature of the fresh food compartment evaporator once more rises to maximum, thermostat 5 closes its contacts to short-circuit defrosting resistor 4, stop defrosting and start compressor 3 up again for another cooling cycle. With this operating mode, manual switch 7 is always open.

For fast-freeze operation of the refrigerator, however, manual switch 7 is closed so that, whenever compressor 3 stops, defrosting resistor 4 is supplied so as to provide for fast defrosting so that another cooling cycle can be started immediately. A starting temperature of −2° C. for defrosting resistor 4 was chosen for two reasons: (1) because of the small temperature difference between the evaporator and the fresh food compartment and consequently the low heat exchange possibility; (2) because, with −2° C. on the fresh food compartment evaporator, the temperature inside the freezer is sure to be below −18° C. In any case, defrosting resistor 4 is powerful enough to complete defrosting before the temperature in the freezer exceeds the maximum. A situation could arise, however, in which, on account of low-load operation or the fact that the freezer is left unopened for a long period of time, even with a temperature of −2° C. on the fresh food compartment evaporator, the freezer does not need cooling in which case natural defrosting could be continued longer.

For this purpose, the alternative arrangement of the present device provides for placing the temperature-sensitive switch 6 inside the freezer and for setting it to a temperature of −18.5° C. In this way, the switch 6 will only close to supply defrosting resistor 4 when the temperature in the freezer rises to −18.5° C., thus avoiding all possible waste by only commencing a new cooling cycle when the compartment requires it. Needless to say, in this case too, defrosting resistor 4 will be powerful enough to ensure defrosting is completed before the freezer temperature reaches −18° C.

Figure 3:
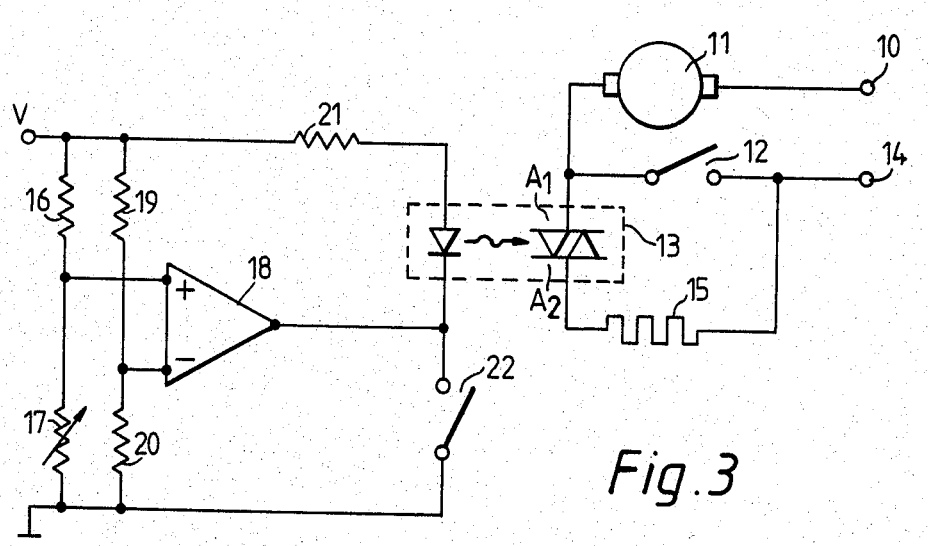
FIG. 3 shows a second possible arrangement of the defrosting device for a refrigerator with more than one cooling compartment.

Reference 10 in FIG. 3 is a terminal to which is connected one end of compressor 11 on a refrigerator with more than one cooling compartment the other end of which is connected to one terminal of switch 12 and one anode ($A_1$) of optotriac 13. The other end of switch 12 is connected to the other terminal 14 and to one end of defrosting resistor 15 on the fresh food compartment evaporator of the said refrigerator, the other end of which is connected to the other anode ($A_2$) of optotriac 13. Switch 12 is controlled by a known type of electronic circuit, not shown in the diagram, which may be of the type described in Italian Patent Application No. 68230-A/80 of July 3rd, 1980 filed by the present applicant.

Reference 16 is a resistor one end of which is connected to a positive d.c. supply (V) while the other end is connected to one end of a negative temperature coefficient (NTC) temperature sensor 17 the other end of which is grounded. The junction of resistor 16 and NTC 17 is connected to the non-inverting input of threshold voltage comparator 18. To the inverting input of the same threshold voltage comparator 18 is connected the junction of resistor 19, the other end of which goes to supply V, and resistor 20, the other end of which is grounded. The output of threshold voltage comparator 18 goes to the cathode of the emitting diode of optotriac 13 the anode of which is connected to one end of resistor 21 the other end of which goes to supply V. The cathode of the emitting diode of optotriac 13 is also connected to one terminal of a manual fast-freeze switch 22 the other terminal of which is grounded.

NTC 17 is placed on the fresh food compartment evaporator and resistors 16, 19 and 20 are designed so that the output of threshold voltage comparator 18 is high when the temperature of the fresh food compartment evaporator is below −2° C. and low when the said temperature is over −2° C. Defrosting resistor 15 is not energized in the first case whereas it is in the second.

In one variation, however, NTC 17 is placed inside the freezer and resistors 16, 19 and 20 are designed so that the output of threshold voltage comparator 18 is high when the temperature of the freezer is below −18.5° C. and low when the temperature is over −18.5° C. In this variation, therefore, the defrosting device combining the present circuit and the one described in the abovementioned patent application has three temperature sensors, one on the fresh food compartment evaporator (9 in FIG. 2 of the abovementioned patent application), one inside the fresh food compartment (13 in FIG. 2 of the abovementioned patent application) and one inside the freezer 17. The defrosting device described operates as follows: as already stated, switch 12 is controlled by the circuit shown in FIG. 2 of the aforementioned patent application to close when the temperature of the evaporator in the freezer exceeds maximum (5° C.) and to open when the temperature of the evaporator falls to a minimum (ranging from −17° to −25° C. according to the setting made by the operator).

It also opens when the temperature in the fresh food compartment moves to below 0° C. (detected by sensor 13 in FIG. 2 of the aforementioned patent application). If the present circuit was not provided with optotriac 13, whenever switch 12 is opened, compressor 11 would be stopped and defrosting resistor 15 would be started by to commence defrosting.

The provision of optotriac 13, however, modifies the cycle as follows: when the temperature of the fresh food compartment evaporator falls to minimum (ranging from −17° to −25° C.) switch 12 opens and compressor 11 stops. Under these conditions, however, the output of threshold voltage comparator 18 is high so that optotriac 13 is open and defrosting resistor 15 is not supplied. This therefore starts off a natural defrosting stage, the temperature of the fresh food compartment evaporator starts to rise and, when it reaches −2° C., the output of threshold voltage comparator 18 switches to low and optotriac 13 is energized so as to close and supply defrosting resistor 15. This starts off a fast defrosting stage which continues until the temperature of the fresh food compartment evaporator reaches 5° C. At this point, switch 12 closes, defrosting resistor 15 is short-circuited and compressor 11 started up for another cooling cycle which continues until the temperature of the fresh food compartment evaporator returns to minimum. Defrosting resistor 15 is therefore only started up between −2° and 5° C. instead of between −25° and 5° C., as in the case of the known technique.

The defrosting resistor 15 must, of course, be powerful enough to complete the defrosting operation before the temperature in the freezer exceeds −18° C. In the case of fast freezing, hand switch 22 is closed so that optotriac 13 is always energized and defrosting resistor 15 always supplied whenever switch 12 is opened. As the resistor is more powerful than the one normally used in the known technique (e.g. 25–30 W as compared with 18 W) it completes defrosting faster, keeps compressor 11 running longer and freezes food faster than the known technique. If, during normal operation or fast freezing, the temperature of the fresh food compartment should fall below 0° C., switch 12 opens to commence natural defrosting, in the case of normal operation, or fast defrosting, in the case of fast freezing. As already stated, a threshold of −2° C. for commencing fast defrosting was selected because, from that point on, the difference in temperature between the fresh food compartment evaporator and the environment is very small and also because, with such a threshold, we can be certain the temperature in the freezer does not exceed −18° C. A situation could arise, however, in which, on account of low-load operation of the freezer or the fact that the freezer is left unopened for a long period of time, even with a temperature of −2° C. on the fresh food compartment evaporator, the freezer does not need cooling in which case natural defrosting could be continued longer. For this purpose, a variation of the present defrosting device provides for placing NTC sensor 17 inside the freezer so that, after compressor 11 stops, natural defrosting continues until the temperature in the freezer reaches −18.5° C. If this temperature is not reached before the temperature of the fresh food compartment evaporator reaches 5° C., a complete natural defrosting cycle would be performed, that is, with no help from defrosting resistor 15.

Figure 4:
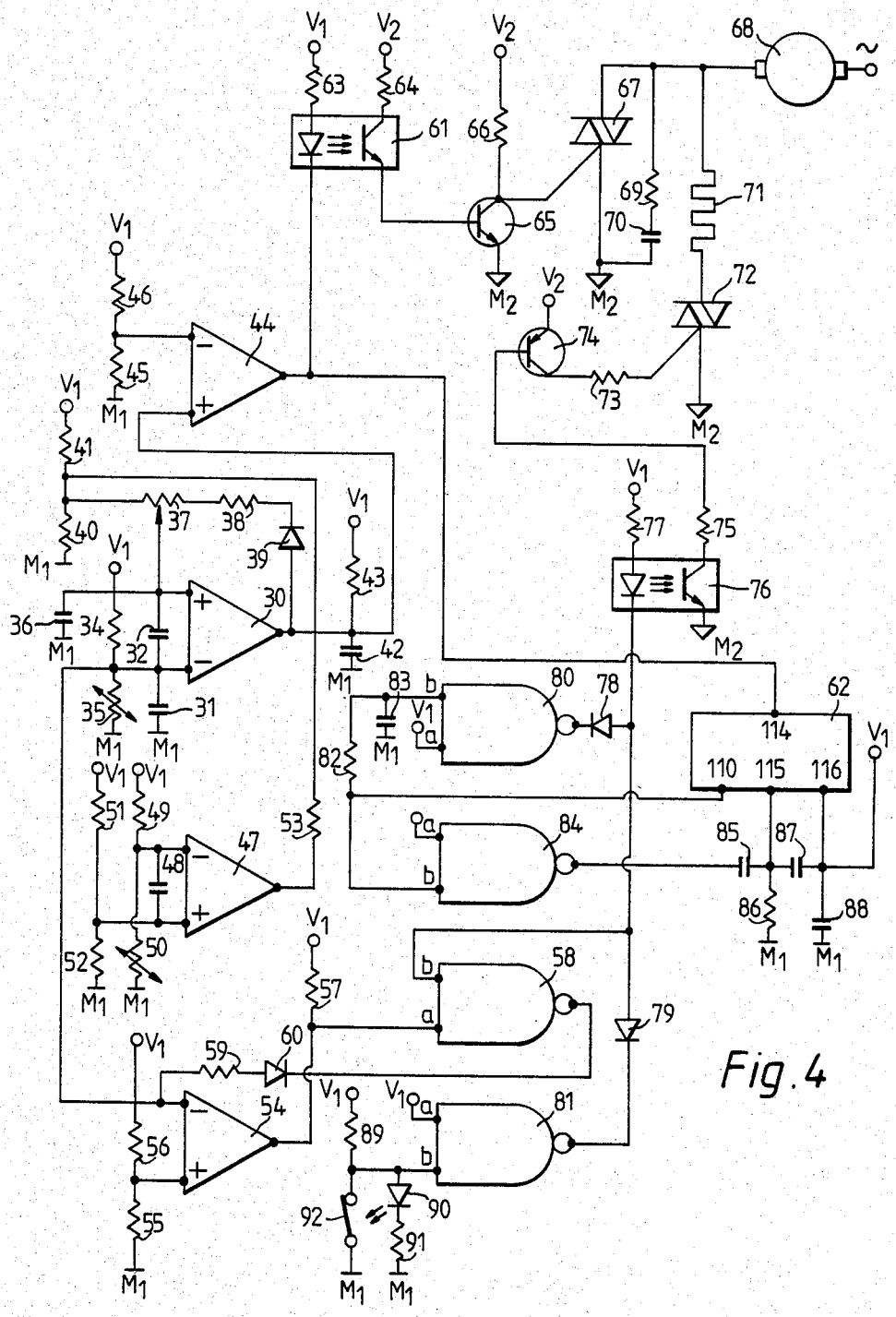
FIG. 4 shows a third possible arrangement of the defrosting device for a refrigerator with more than one cooling compartment.

The FIG. 4 circuit is a variation of the one shown in FIG. 3 whereby fast defrosting only takes place every "n" cycles. FIG. 4 shows: a threshold voltage comparator 30 with hysteresis whose inverting input is connected to one end of condenser 31, the other end of which is grounded ($M_1$), to one end of condenser 32, the other end of which goes to the non-inverting input of the same threshold voltage comparator 30, to one end of resistor 34, the other end of which is connected to (positive d.c.) supply V1, and to one end of negative temperature coefficient temperature sensor (NTC) 35, the other end of which is grounded ($M_1$). The non-inverting input of threshold comparator 30 is also connected to one end of condenser 36, the other end of which is grounded ($M_1$), and to the middle terminal of potentiometer 37. One side terminal on potentiometer 37 is connected to one end of resistor 38, the other end of which goes to the cathode of diode 39, the anode of which is connected to the output of threshold voltage comparator 30.

The other side terminal on potentiometer 37 goes to the junction of resistor 40, the other end of which is grounded ($M_1$), and resistor 41, the other end of which goes to supply $V_1$.

The output of threshold voltage comparator 30 also goes to one end of condenser 42, the other end of which is grounded ($M_1$), to one end of resistor 43, the other end of which goes to supply $V_1$, and to the non-inverting input of operational amplifier 44, the inverting input of which is connected to the junction of resistor 45, the other end of which is grounded ($M_1$), and resistor 46, the other end of which goes to supply $V_1$.

A hysteresis-free threshold voltage comparator 47 to whose inverting input are connected one end of condenser 48, the other end of which goes to the non-inverting input of the same threshold voltage comparator 47, and the junction of resistor 49, the other end of which goes to supply $V_1$, and negative temperature coefficient (NTC) temperature sensor 50, the other end of which is grounded ($M_1$). The non-inverting input of threshold voltage comparator 47 is also connected to the junction of resistor 51, the other end of which goes to supply $V_1$, and resistor 52, the other end of which is grounded ($M_1$). Via resistor 53, the output of threshold voltage comparator 47 goes to the junction of resistors 40 and 41.

A hysteresis-free threshold voltage comparator 54 to whose inverting input is connected the junction of resistor 34 and temperature sensor 35 and to whose non-inverting input is connected the junction of resistor 55, the other end of which is grounded ($M_1$), and resistor 56, the other end of which goes to supply $V_1$. Via resistor 57, the output of threshold voltage comparator 54 goes to supply $V_1$ and input "a" of NAND gate 58. The junction of resistor 34 and NTC sensor 35 is also connected to one end of resistor 59, the other end of which goes to the anode of diode 60, the cathode of which is connected to the output of NAND gate 58.

The output of operational amplifier 44 goes to the cathode of an emitting diode on optotransistor 61 and to the clock (pin 114) of a decimal counter 62. The anode of the emitting diode on optotransistor 61 goes to supply $V_1$ via resistor 63. Via resistor 64, the collector of optotransistor 61 goes to supply $V_2$ (positive d.c. but separate from the $V_1$ supply). The emitter of optotransistor 61 goes to the base of NPN transistor 65, the emitter of which is grounded ($M_2$) (electrically apart from ground $M_1$). The circuit elements connected to terminals $V_1$–$M_1$ and $V_2$–$M_2$ are electrically separate and form two independent circuits, that is, with no electrical connections in common, therefore insulated as per safety standards. Via resistor 66, the collector of transistor 65 goes to supply $V_2$ and the gate of triac 67.

One of the two anodes on triac 67 is grounded ($M_2$) while the other goes to one end of the windings on compressor 68, the other end of which goes to a terminal on the a.c. voltage supply. Resistor 69 and condenser 70 are connected between the two anodes on triac 67. The end of the winding on compressor 68 connected to triac 67 is also connected to one end of 18 W defrosting resistor 71, the other end of which is connected to an anode on triac 72. The other anode on triac 72 is connected to ground $M_2$ to which is also connected the other terminal on the a.c. voltage supply. Via resistor 73, the gate of triac 72 is connected to the collector of PNP transistor 74, the emitter of which is connected to supply $V_2$. To the base of transistor 74, via resistor 75, is connected the collector of optotransistor 76, the emitter of which is grounded ($M_2$). Via resistor 77, the anode of the emitting diode on optotransistor 76 goes to supply $V_1$, while the cathode goes to the anode of diode 78, to the anode of diode 79 and to the "b" input of NAND gate 58. The cathode of diode 78 is connected to the output of NAND gate 80, while the cathode of diode 79 is connected to the output of NAND gate 81. Input "b" of NAND gate 80 goes to one end of resistor 82 and to one end of condenser 83, the other end of which is grounded ($M_1$). The other end of resistor 82 goes to the output (pin 110) of decimal counter 62 which is also connected to input "b" of NAND gate 84.

Inputs "a" of NAND gates 80, 81 and 84 are connected to supply $V_1$. The output of NAND gate 84 goes to one end of condenser 85. The other end of condenser 85 goes to one end of resistor 86, the other end of which is grounded ($M_1$), to one end of condenser 87 and to the reset (pin 115) of counter 62. The other end of condenser 87 goes to supply $V_1$, to the supply (pin 116) of counter 62 and to one end of condenser 88, the other end of which is grounded ($M_1$). Input "b" of NAND gate 81 is connected to the junction of one end of resistor 89, the other end of which goes to supply $V_1$, and the anode of light emitting diode 90, the cathode of which goes to one end of resistor 91, the other end of which is grounded ($M_1$).

The input "b" of NAND gate 81 is also connected to one end of a manual switch 92, the other end of which is grounded ($M_1$). Manual switch 92 forms part of potentiometer 37. It is normally closed and is opened when the switch on the potentiometer 37 is on the last setting.

To understand how the present defrosting device works, it should be pointed out that compressor 68 forms part of a refrigerating circuit with more than one refrigerating compartment, that NTC 35 is placed on the fresh food compartment evaporator and that NTC 50 is placed inside the fresh food compartment. Furthermore, we shall commence from fast defrosting of the fresh food compartment evaporator by defrosting resistor 71. When the temperature of the fresh food compartment evaporator (detected by NTC 35) reaches 5° C. (defrosting over), the output of threshold voltage comparator 30 switches to high. Via operational amplifier 44, this voltage is transmitted to the cathode of the emitting diode on optotransistor 61 which stops conducting and so disables both optotransistor 61 and transistor 65. A positive signal is therefore sent to the gate of triac 67 which closes to start up compressor 68 and cool the refrigerator.

When the output of operational amplifier 44 switches to high, a positive pulse is sent to the clock (pin 114) on counter 62 which moves forward one step. Compressor 68 keeps running until the temperature of the fresh food compartment evaporator falls to minimum (ranging from −17° to −25° C., depending on how the operator has set potentiometer 37). When the threshold is exceeded downwards, the output of threshold voltage comparator 30 switches to low and compressor 68 stops conducting. Defrosting resistor 71 is ineffective in that triac 72 is open. Natural defrosting therefore commences and continues until the temperature of the fresh food compartment evaporator reaches −2° C. When this threshold is exceeded upwards, the output of threshold voltage comparator 54 switches to high and a logic 1 is sent to input "a" on NAND gate 58. As input "b" of the gate is also logic 1, the output of NAND gate 58 will be low. The branch formed by resistor 59 and diode 60 (parallel to NTC 35) starts conducting and the voltage at the inverting input of threshold voltage comparator 30 is lowered to simulate the fresh food compartment evaporator reaching 5° C. A second pulse is thus sent to the clock on counter 62, which moves forward a second step, and a second cooling cycle is commenced. This is repeated for 4 cycles. At the end of the fourth natural defrosting cycle, a fifth pulse is sent to the clock on counter 62 which moves a fifth step forward and raises the voltage at its output (pin 110) so that a logic 1 is sent to inputs "b" of NAND gates 80 and 84. As input "a" of NAND gate 80 is also high, the output of the NAND gate 80 switches to low, the emitting diode of optotransistor 76 starts conducting, optotransistor 76 and transistor 74 becomes saturated and a positive signal is sent to the gate of triac 72 which closes to enable the supply of defrosting resistor 71. At the same time, compressor 68 also receives the starting signal for commencing the fifth cooling cycle. It is possible, however, that the branch formed by counter 62, NAND gate 80, optotransistor 76, transistor 74 and triac 72 may be faster than the branch formed by optotransistor 61, transistor 65 and triac 67 so that a fast defrosting cycle via defrosting resistor 71 may be started instead of the fifth cooling cycle. To prevent this from happening, the signal sent to input "b" of NAND gate 80 is delayed by resistor 82 and condenser 83 so that the fifth cooling cycle is sure to be started. When triac 67 opens at the end of the fifth cooling cycle, as triac 72 is closed, defrosting resistor 71 is supplied and a fast defrosting cycle started and continued until the temperature of the fresh food compartment evaporator reaches 5° C. During this fifth cycle, input "b" of NAND gate 58 is low so that the input of the same NAND gate 58 will be high, and, as the branch formed by resistor 59 and diode 60 is not conducting, threshold voltage comparator 30 switches when NTC 35 detects a temperature of 5° C. At the end of the fifth (fast) defrosting cycle, a sixth clock is sent to counter 62, which moves a sixth step forward, its pin 110 switches back to low and the logic 0 is sent to input "b" of NAND gate 84 (which was high). As its "a" input is high at the output of NAND gate 84, a positive pulse will be formed and transmitted, via condenser 85, to the reset (pin 115) of counter 62 which will be zeroed and start counting again from the beginning. In other words, this sixth clock pulse becomes the first clock pulse of a new set of cycles. Condenser 85 has been provided between the output of NAND gate 84 and the reset of counter 62 to "form" the reset pulse and ensure the pulse is detected at all times by counter 62. In other words, the circuit described above provides for natural defrosting, for four out of five cycles and fast defrosting, with the aid of defrosting resistor 71, for one out of five cycles. The natural defrosting cycles terminate when the temperature of the fresh food compartment evaporator reaches −2° C. to avoid any danger of the temperature in the freezer exceeding −18° C.

During fast freezing operation, manual switch 92 is opened which lights up indicator LED 90 and produces a high signal at input "b" of NAND gate 81. As input "a" of the NAND gate 81 is also high, the output of NAND gate 81 will be low, the emitting diode of optotransistor 76 will conduct, triac 72 will be closed and defrosting resistor 71 will be supplied in all the cycles. Fast defrosting will therefore be performed in all the cycles thus reducing food freezing time. In this case too, defrosting terminates when the temperature of the fresh food compartment evaporator reaches 5° C. in that, as the emitting diode of optotransistor 76 is still conductive, the branch formed by resistor 59 and diode 60 remains inactive. Whether operating normally or in fast-freeze mode, if the temperature of the fresh food compartment evaporator moves below 0° C., the output of threshold voltage comparator 47 switches to low, the references at the non-inverting input of threshold voltage comparator 30 are changed and compressor 68 is stopped.

In an alternative arrangement, the inverting input of threshold voltage comparator 54 could be connected to a branch comprising a temperature sensor inside the freezer and resistors 34, 55 and 56 could be set so that the output of threshold voltage comparator 54 switches to high when the temperature in the said freezer exceeds −18.5° C. upwards. This arrangement would only start fast defrosting when the freezer actually needed it thus providing for further energy saving. In another arrangement, triacs 13, 67 and 72 in the FIGS. 3 and 4 circuits could be replaced by a relay.

Part list:

30, 44, 47, 54 Quadruple differential comparator LM339
58, 80, 81, 84 Dual-input quadruple NAND gate CD4011
62 Decimal counter CD4017
61, 76 Optotransistor 4N37
72 Triac T25OOD
67 Triac MAC15
65 Transistor BC337
74 Transistor BC327
39, 60, 78, 79 Diode 1N4148
90 LED FLD 460
35 NTC M822/82/9.4KΩ
50 NTC K243
37 Potentiometer 4.7KΩ linear
71 Resistor 18 W
63 Resistor 180Ω ½ W 5%

73 Resistor 220Ω ½ W 5%
89 Resistor 470Ω ½ W 5%
45, 63, 91 Resistor 1KΩ ¼ W 5%
60 Resistor 1KΩ ½ W 5%
33, 77 Resistor 3.3KΩ ¼ W 5%
51 Resistor 3.4KΩ ¼ W 1%
49 Resistor 4.27KΩ ¼ W 1%
53 Resistor 4.7KΩ ¼ W 5%
34 Resistor 4.87KΩ ¼ W 1%
59 Resistor 5.6KΩ ¼ W 5%
46, 57, 64, 82 Resistor 10KΩ ¼ W 5%
55 Resistor 11.3KΩ ¼ W 1%
38 Resistor 12KΩ ¼ W 5%
40 Resistor 13.8KΩ ¼ W 1%
52 Resistor 16.5KΩ ¼ W 1%
56 Resistor 24.5KΩ ¼ W 1%
31, 32, 36, 42, 48, 83, 87, 88 Ceramic condenser 0.1 μF
70 Polyester condenser 0.1 μF 400 V
85 Ceramic condenser 470 nF The advantages of the defrosting device for a refrigerator with more than one cooling compartment covered by the present invention will be clear from the description given.

In particular, the saving in energy which, from tests carried out on working prototypes, has proved to be 10% as compared with the known technique; faster food freezing which, from tests carried out on the same prototypes, has proved to be 20% as compared with the known technique; and, finally, the simplicity, reliability and low cost of the circuitry involved.

To those skilled in the art it will be clear that various changes can be made to the device described by way on a nonlimiting example without, however, departing from the scope of the present invention.

What is claimed is:

1. Defrosting device for a refrigerator comprising a number of cooling compartments, of which at least one is used for storing fresh food and at least a second for storing frozen food, at least a first evaporator assigned to the fresh food compartment and at least a second evaporator assigned to the freezer, both with refrigerating fluid flowing through them in a series circuit, a compressor for compressing the refrigerating fluid, a condenser for condensing the refrigerating fluid from the compressor, a capillary tube for supplying the refrigerating fluid from the condenser to the second evaporator, a tube for supplying the refrigerating fluid from the second evaporator to the first evaporator, a return pipe connecting the outlet of the first evaporator to the inlet on the compressor, and control means for stopping the compressor when the temperature of the first evaporator is lower than a first threshold, whereby the defrosting device provide for;

heating means that are not used for removing frost during the greater part of the time when the compressor is off; and means for enabling said heating means to supply the first evaporator with a predetermined amount of heat, as a consequence that the temperature of one of said first and second evaporators, during the time the compressor is off, has respectively exceeded a second temperature threshold having a value lower than 0° C., or a third temperature threshold having a value around 19° C. heating; means being enabled, during the time the compressor is off, at least during one out of "n" on-off cycles of the compressor working.

2. Defrosting device for a refrigerator according to claim 1, characterized by the fact that the said heating means are enabled during some time of each operating on-off cycle of the compressor.

3. Defrosting device for a refrigerator according to claim 1, characterized by the fact that the said heating means are enabled during some time of only one out of "n" operating on-off cycles of the compressor.

4. Defrosting device for a refrigerator according to claim 1 characterised by the fact that the said heating means only supply the said first evaporator with heat during one out of "n" operating cycles of the refrigerator.

5. Defrosting device for a refrigerator according to claim 1, characterised by the fact that the said heating means comprise a defrosting resistor (4, 15), in thermal contact with the said first fresh food compartment evaporator, which is only powered for supplying heat to the said first evaporator when one of the said temperature thresholds is exceeded.

6. Defrosting device for a refrigerator according to claim 4, characterised by the fact that the said heating means comprise a defrosting resistor (71), in thermal contact with the said first fresh food compartment evaporator, which is only powered for supplying heat to the said first evaporator during one out of "n" cycles.

7. Defrosting device for a refrigerator according to claim 5, characterised by the fact that the said defrosting resistor (4, 15) is powerful enough to ensure defrosting is completed before the temperature of the said second freezer compartment exceeds the temperature allowed for preserving the food inside safely.

8. Defrosting device for a refrigerator according to claim 7, characterized by the fact that the power of the said defrosting resistor is around 25–30 W.

9. Defrosting device for a refrigerator according to claim 2, characterised by the fact that, when freezing fresh food just placed inside the said second compartment, the said heating means supply the said first fresh food compartment evaporator with heat for as long as the said compressor (3, 11) on the refrigerating circuit is off.

10. Defrosting device for a refrigerator according to claim 4, characterised by the fact that, when freezing fresh food just placed inside the said second compartment, the said heating means supply the said first fresh food compartment evaporator with heat during all the cooling cycles.

11. Defrosting device for a refrigerator according to claim 5, characterised by the fact that the said heating means comprise a temperature-sensitive switch element (6, 13) on the supply circuit of the said defrosting resistor (4, 15).

12. Defrosting device for a refrigerator according to claim 11, characterised by the fact that the said temperature-sensitive switch element (6) is open, thus disabling supply to the said defrosting resistor (4) when the temperature it detects is below one of the said thresholds, whereas it is closed, thus enabling supply to the said defrosting resistor (4) when the temperature it detects is over one of the said thresholds.

13. Defrosting device for a refrigerator according to claim 11, characterised by the fact that the said temperature-sensitive switch element (6) is in thermal contact with the said first fresh food compartment evaporator.

14. Defrosting device for a refrigerator according to claim 11, characterised by the fact that the said temperature-sensitive switch element (6) is placed inside the said second freezer compartment.

15. Defrosting device for a refrigerator according to claim 11, characterised by the fact that the said temperature-sensitive switch element (6) is a mechanical thermostat.

16. Defrosting device for a refrigerator according to claim 11, characterised by the fact that the said heating means comprise a manual switch (7) which is closed when freezing fresh food just placed inside the said second compartment, thus enabling supply of the said defrosting resistor (4) as long as the said compressor (3) is off, thus providing for faster freezing of the food.

17. Defrosting device for a refrigerator according to claim 11, characterised by the fact that the said switch element comprises an optotriac (13).

18. Defrosting device for a refrigerator according to claim 11, characterised by the fact that the said switch element comprises a relay.

19. Defrosting device for a refrigerator according to claim 11, characterised by the fact that the said switch element (13) comprises a threshold voltage comparator (18).

20. Defrosting device for a refrigerator according to claim 19, characterised by the fact that the said threshold voltage comparator (18) switches its output depending on the temperature detected by a negative temperature coefficient temperature sensor (17) in a resistive network which sends a voltage proportional with the said temperature to one of its inputs.

21. Defrosting device for a refrigerator according to claim 20, characterised by the fact that the output of the said threshold voltage comparator (18) is high, thus disabling supply of the said defrosting resistor (15), when the temperature detected by the said temperature sensor (17) is below the said threshold, whereas it is low, thus allowing supply of the said defrosting resistor (15), when the temperature detected by the said temperature sensor (17) is over the said threshold.

22. Defrosting device for a refrigerator according to claim 20, characterised by the fact that the said temperature sensor (18) is in thermal contact with the said first fresh food compartment evaporator.

23. Defrosting device for a refrigerator according to claim 20, characterised by the fact that the said temperature sensor is placed inside the said second freezer compartment.

24. Defrosting device for a refrigerator according to claim 5, characterised by the fact that the said heating means comprise a manual switch (22) which, when freezing fresh food just placed inside the said second freezer compartment, is closed so as to keep the output of the said threshold voltage comparator (18) low, regardless of the temperature detected by the said temperature sensor (17), thus enabling supply of the said defrosting resistor (15) as long as the compressor (11) is off and providing for faster freezing of the food.

25. Defrosting device for a refrigerator according to claim 4, characterised by the fact that the said heating means only supply the said first fresh food compartment evaporator with heat during one out of five operating cycles of the refrigerator.

26. Defrosting device for a refrigerator according to claim 4, characterised by the fact that, during the remaining "n−1" cycles in which no heat is supplied to the said first fresh food compartment evaporator, a new cooling cycle is started when a first temperature limit is exceeded, whereas, in the nth cycle in which heat is supplied to the said first fresh food compartment evaporator, a new cooling cycle is started when a second temperature limit higher than the first is exceeded.

27. Defrosting device for a refrigerator according to claim 26, characterised by the fact that the said first temperature limit is around −2° C. and the said second around 5° C.

28. Defrosting device for a refrigerator according to claim 26, characterised by the fact that the said operating mode is provided for by two threshold voltage comparators (30, 54), a NAND gate (58) and a resistive network (59, 60).

29. Defrosting device for a refrigerator according to claim 28, characterised by the fact that, when the said first temperature limit is exceeded, the output of the said threshold voltage comparator (54) switches to high, the output of the said NAND gate (58) switches to low, the resistive network (59, 60) starts conducting and the reference at the inverting input of the said threshold voltage comparator (30) is changed so as to raise its output which is normally raised when the said second temperature limit is exceeded.

30. Defrosting device for a refrigerator according to claim 4, characterised by the fact that it comprises a cooling cycle counter consisting of a counter (62) and a clock circuit (44) which produces a pulse whenever the temperature of the said first evaporator exceeds a given preset threshold, and by the fact that an output signal is picked up by the counter (62) every nth cooling cycle for controlling the supply of the said amount of additional heat.

31. Defrosting device for a refrigerator according to claim 30, characterised by the fact that the said counter is a decimal counter and that an output signal is picked up by one of its output pins (110) which switches to high every fifth clock pulse.

32. Defrosting device for a refrigerator according to claim 6, characterised by the fact that the said output signal of the said counter (62) controls a circuit for resetting the said counter (62) and a circuit for enabling supply of the said defrosting resistor (71).

33. Defrosting device for a refrigerator according to claim 32, characterised by the fact that the said reset circuit comprises a condenser (85) the function of which is to "form" the reset pulse so as to ensure it is always received by the said counter (62).

34. Defrosting device for a refrigerator according to claim 32, characterised by the fact that the said circuit for enabling supply of the said defrosting resistor (71) is preceded by a delaying device, consisting of a resistor (82) and a condenser (83), to ensure the said consent circuit is enabled after the compressor (68) on the refrigerating circuit has started.

35. Defrosting device for a refrigerator according to claim 32, characterised by the fact that the said circuit for enabling supply of the said defrosting resistor (71) comprises a NAND gate (80), an optotransistor (77) and a triac (72).

36. Defrosting device for a refrigerator according to claim 32, characterised by the fact that the said circuit for enabling supply of the said defrosting resistor (71) comprises a relay.

37. Defrosting device for a refrigerator according to claim 35, characterised by the fact that, when a positive signal is sent to the input of the said NAND gate (80), the optotransistor (77) starts conducting and the triac

(72) closes thus enabling supply of the said defrosting resistor (71).

38. Defrosting device for a refrigerator according to claim 34, characterised by the fact that the said compressor (68) is started and stopped by an optotransistor (64) and a triac (67).

39. Defrosting device for a refrigerator according to claim 34, characterised by the fact that the said compressor (68) is started and stopped by a relay.

40. Defrosting device for a refrigerator according to claim 9, characterised by the fact that the said triac (67) or the said relay is normally closed so that, in the event of a breakdown on the circuit, the said compressor (68) keeps running to preserve the stored food.

41. Defrosting device for a refrigerator according to claim 13, characterised by the fact that the said defrosting resistor (71) is supplied in all the operating cycles by means of a manual switch (92) and a NAND gate (81).

42. Defrosting device for a refrigerator accordng to claim 41, characterised by the fact that, when the said manual switch (92) is opened, the output of the said NAND gate (81) switches to low, the optotransistor (77) starts conducting and the triac (72) closes, thus enabling supply of the said defrosting resistor (71) in all the operating cycles.

* * * * *

UNITED STATES PATENT AND TRADEMARK OFFICE

CERTIFICATE OF CORRECTION

PATENT NO. : 4,530,217

DATED : July 23, 1985

INVENTOR(S) : Alluto et al

It is certified that error appears in the above-identified patent and that said Letters Patent is hereby corrected as shown below:

Column 2, line 16 delete "present" insert --preset--.

Column 4, line 34 delete "asembled" insert --assembled--

Column 6, line 20 delete "by" insert --up--.

Column 8, line 26 delete "supply".

Column 10, line 50 delete "Figs." insert --Fig.--.

Signed and Sealed this

*Eleventh* Day of *February 1986*

[SEAL]

*Attest:*

DONALD J. QUIGG

*Attesting Officer*

*Commissioner of Patents and Trademarks*